US011049358B2

(12) United States Patent
Salmon

(10) Patent No.: US 11,049,358 B2
(45) **Date of Patent: *Jun. 29, 2021**

(54) GAMES WITH DYNAMICALLY MODIFIABLE PRIZES BASED ON GAME WINNING SYMBOL POSITIONS

(71) Applicant: Aristocrat Technologies Australia Pty Limited, North Ryde (AU)

(72) Inventor: Christian James Salmon, Manly (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/746,269

(22) Filed: Jan. 17, 2020

(65) Prior Publication Data

US 2020/0152001 A1 May 14, 2020

Related U.S. Application Data

(63) Continuation of application No. 16/145,020, filed on Sep. 27, 2018, now Pat. No. 10,692,324.

(30) Foreign Application Priority Data

Sep. 28, 2017 (AU) ..... 2017903934
Apr. 17, 2018 (AU) ..... 2018202650

(51) Int. Cl.
*G07F 17/32* (2006.01)
*G07F 17/34* (2006.01)

(52) U.S. Cl.
CPC ..... *G07F 17/3213* (2013.01); *G07F 17/34* (2013.01)

(58) Field of Classification Search
CPC ..... G07F 17/32
See application file for complete search history.

(56) References Cited

U.S. PATENT DOCUMENTS

| | | | |
|---|---|---|---|
| 6,309,300 | B1 | 10/2001 | Glavich |
| 2004/0005919 | A1 | 1/2004 | Walker et al. |
| 2005/0159211 | A1 | 7/2005 | Englman |
| 2015/0031437 | A1 | 1/2015 | Gomez et al. |

*Primary Examiner* — Omkar A Deodhar
(74) *Attorney, Agent, or Firm* — McAndrews, Held & Malloy, Ltd.

(57) ABSTRACT

An electronic gaming machine includes a game controller, a player interface, and a display. The game controller causes the display to display a bonus array having visual elements. Each of the visual elements is uniquely associated with one of a plurality of symbol display positions, at least one visual element indicating a bonus award. The game controller selects a symbol for display at each of the symbol display positions, determines whether at least one of the symbol display positions contains a trigger symbol, and upon determining that the at least one of the symbol display positions contains a trigger symbol, determines a modification to a base prize based at least in part on a visual element associated with the symbol display position containing the trigger symbol.

20 Claims, 9 Drawing Sheets

GAMES WITH DYNAMICALLY MODIFIABLE PRIZES BASED ON GAME WINNING SYMBOL POSITIONS

RELATED APPLICATIONS

This application is a continuation of U.S. patent application Ser. No. 16/145,020, filed on Sep. 27, 2018, entitled "Games with Dynamically Modifiable Prizes Based on Game Winning Symbol Positions," which claims priority to Australian Patent Application No. 2017903934, with a filing date of Sep. 28, 2017 and Australian Patent Application No. 2018202650, with a filing date of Apr. 17, 2018; all of which are incorporated herein by reference in their entireties.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

BRIEF SUMMARY

According to an aspect of the present disclosure, there is provided an electronic gaming machine comprising a game controller, a player interface, and a display, wherein the game controller is configured to: generate and cause the display of a bonus array, wherein the bonus array comprises a plurality of visual elements, each uniquely associated with a symbol display position at which a symbol will be displayed during play of the base game, each visual element indicating a particular bonus award; perform gameplay by selecting a symbol for display at each of a plurality of symbol display positions from a group of symbols including one or more trigger symbols and one or more non-trigger symbols and is associated the symbol display position; determine whether one or more symbol display positions contain trigger symbols; and upon one or more symbol display positions containing trigger symbols, determine a modification to the base prize in dependence on the bonus associated with the, or each, visual element associated with a symbol display position containing a trigger symbol.

Optionally, each visual element is associated with a numerical value for addition to the base prize or a multiplier for multiplying the base prize when the base prize is modified.

The bonus array may be displayed on the same display as the base game. Alternatively, the bonus array may be displayed on an auxiliary display.

Each visual element is optionally selected from a group of visual elements.

Optionally, the game controller is further configured to change the visual elements of the bonus array after every N plays of the base game (where $N \geq 1$). In another option, the game controller is further configured to change the visual elements of the bonus array between plays of the base game in accordance with a predefined probability. The game controller may be further configured to change the visual elements of the bonus array in response to a player input. Optionally, the bonus array is displayed on a touch screen and the game controller is further configured to enable a player to move a visual element via a touch input.

The probability of a trigger symbol being associated with a particular symbol display position may at least in part be determined by a requirement to meet a predetermined criterion.

Optionally, the game controller is further configured to cause an animated removal of the, or each, symbol display position containing a trigger symbol to be displayed on the display.

According to another aspect of the present disclosure, there is provided a method of operating a gaming machine comprising a game controller, a player interface, and a display, comprising the steps of: generating and causing the display of a bonus array, wherein the bonus array comprises a plurality of visual elements, each uniquely associated with a symbol display position at which a symbol will be displayed during play of the base game, each visual element indicating a particular bonus award; performing gameplay by selecting a symbol for display at each of a plurality of symbol display positions from a group of symbols including one or more trigger symbols and one or more non-trigger symbols and is associated the symbol display position; determining that one or more symbol display positions contain trigger symbols; and in response, determining a modification to the base prize in dependence on the bonus associated with the, or each, visual element associated with a symbol display position containing a trigger symbol.

Optionally, each visual element is associated with a numerical value for addition to the base prize or a multiplier for multiplying the base prize when the base prize is modified.

The bonus array may be displayed on the same display as the base game. Alternatively, the bonus array may be displayed on an auxiliary display.

Each visual element may be selected from a group of visual elements.

Optionally, the method further comprises the step of changing the visual elements of the bonus array after every N plays of the base game (where N≥1). In another option, the method further comprises the step of changing the visual elements of the bonus array between plays of the base game in accordance with a predefined probability. The method may further comprise the step of changing the visual elements of the bonus array in response to a player input. The bonus array may be displayed on a touch screen and the method may further comprise the step of enabling a player to move a visual element via a touch input.

Optionally, the probability of a trigger symbol being associated with a particular symbol display position is at least in part determined by a requirement to meet a predetermined criterion.

The method may further comprise the step of displaying an animation showing removal of the, or each, symbol display position containing a trigger symbol.

As used herein, the word "comprise" or variations such as "comprises" or "comprising" is used in an inclusive sense, i.e. to specify the presence of the stated features but not to preclude the presence or addition of further features in various embodiments of the disclosure.

BRIEF DESCRIPTION OF SEVERAL VIEWS OF THE DRAWINGS

An exemplary embodiment of the disclosure will now be described with reference to the accompanying drawings in which.

DETAILED DESCRIPTION

Figure 1:
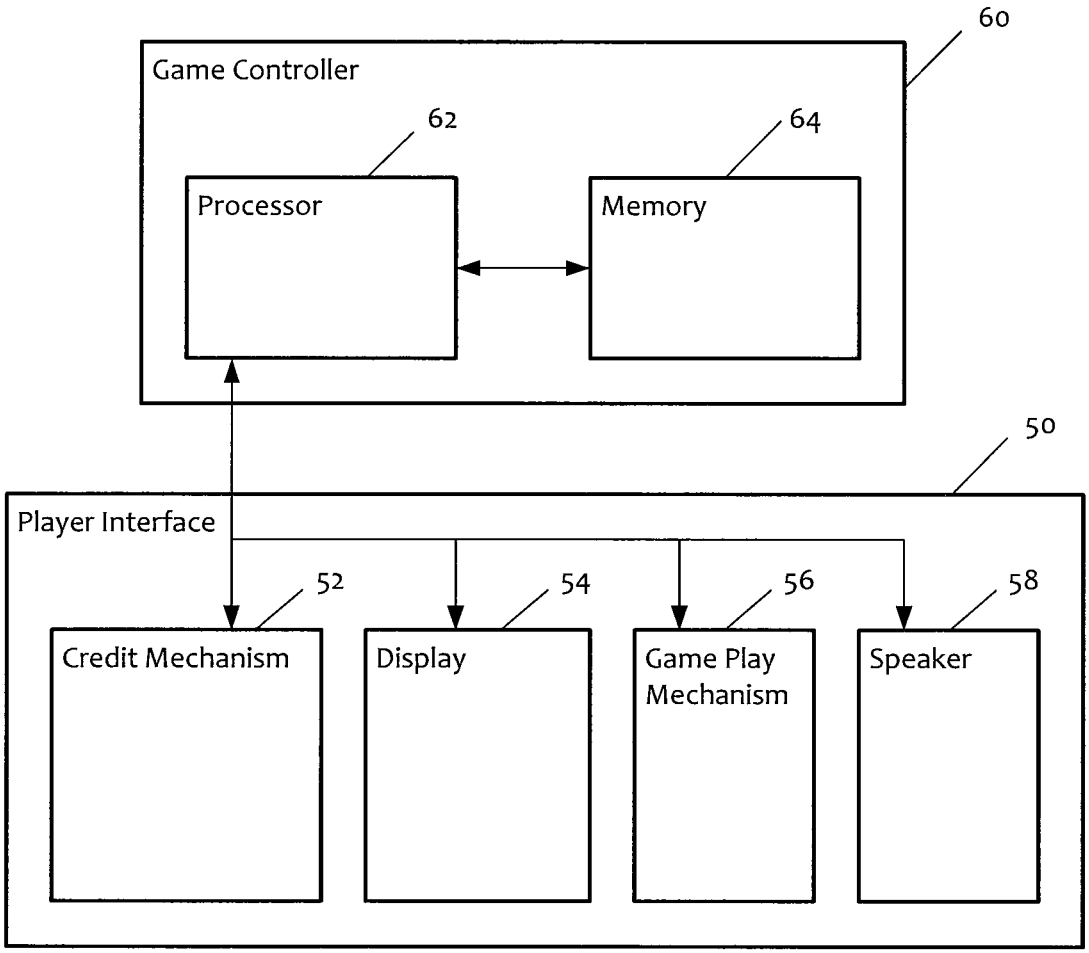
FIG. 1 is a block diagram of the core components of a gaming system.

Referring to the drawings, there is shown a gaming system having a dynamically generated bonus array.

General Construction of Gaming System

The gaming system can take a number of different forms. In a first form, a stand-alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand-alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
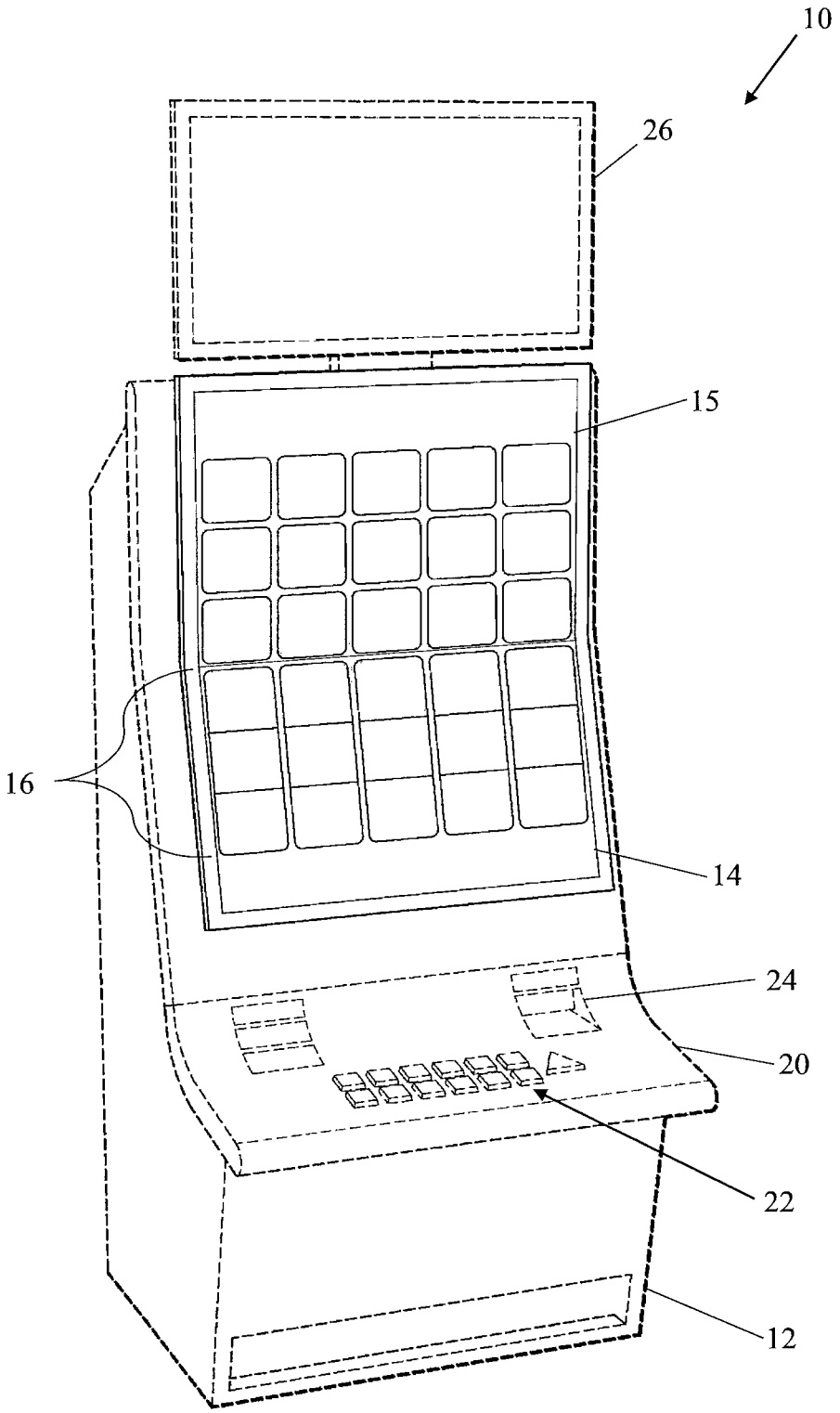
FIG. 2 is a perspective view of a stand-alone gaming machine.

A gaming system in the form of a stand-alone gaming machine 10 is illustrated in FIG. 2. The gaming machine 10 includes a console 12 having a display 14 on which are displayed representations of a game 16 that can be played by a player. A mid-trim 19 of the gaming machine 10 houses a bank of buttons 22 for enabling a player to interact with the gaming machine, in particular during game play. The mid-trim 20 also houses a credit input mechanism 24 which in this example includes a coin input chute and a bill collector. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork, including for example pay tables and details of bonus awards and other information or images relating to the game. Further artwork and/or information may be provided on a front panel of the console 12.

The display 14 comprise a liquid crystal display, plasma screen, cathode ray tube (CRT), or any other suitable video display unit, or the visible portion of an electromechanical device. The gaming machine 10 may comprise (as shown in the example) an auxiliary display 15, and the top box 26 may also include a top box display.

Figure 3:
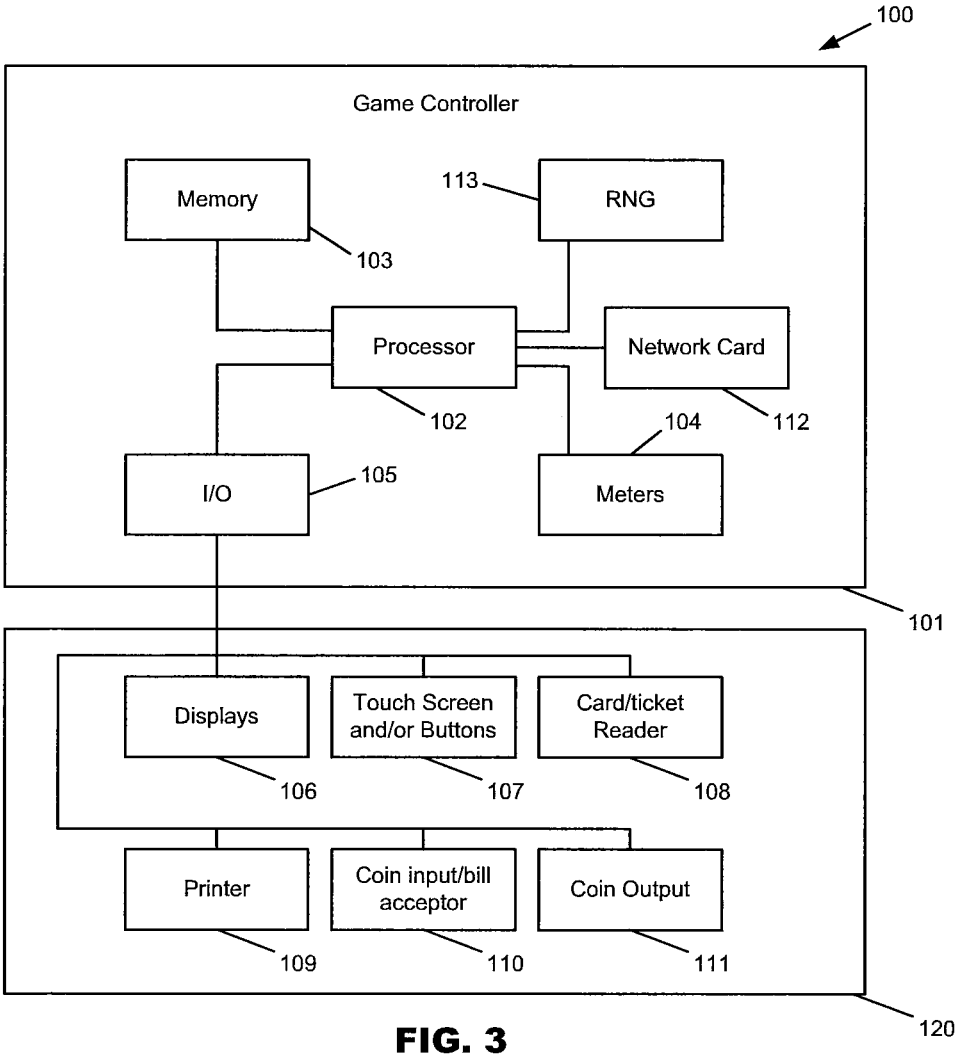
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
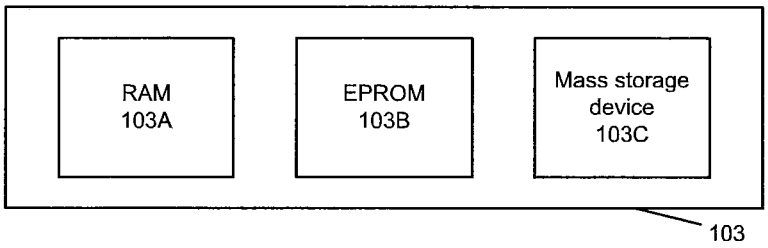
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices such as one or more displays 106, touch screen and/or buttons 107, card and/or ticket reader 108, printer 109, bill acceptor and/or coin input mechanism 110, coin output mechanism 111 to be provided remotely from the game controller 101.

Figure 5:
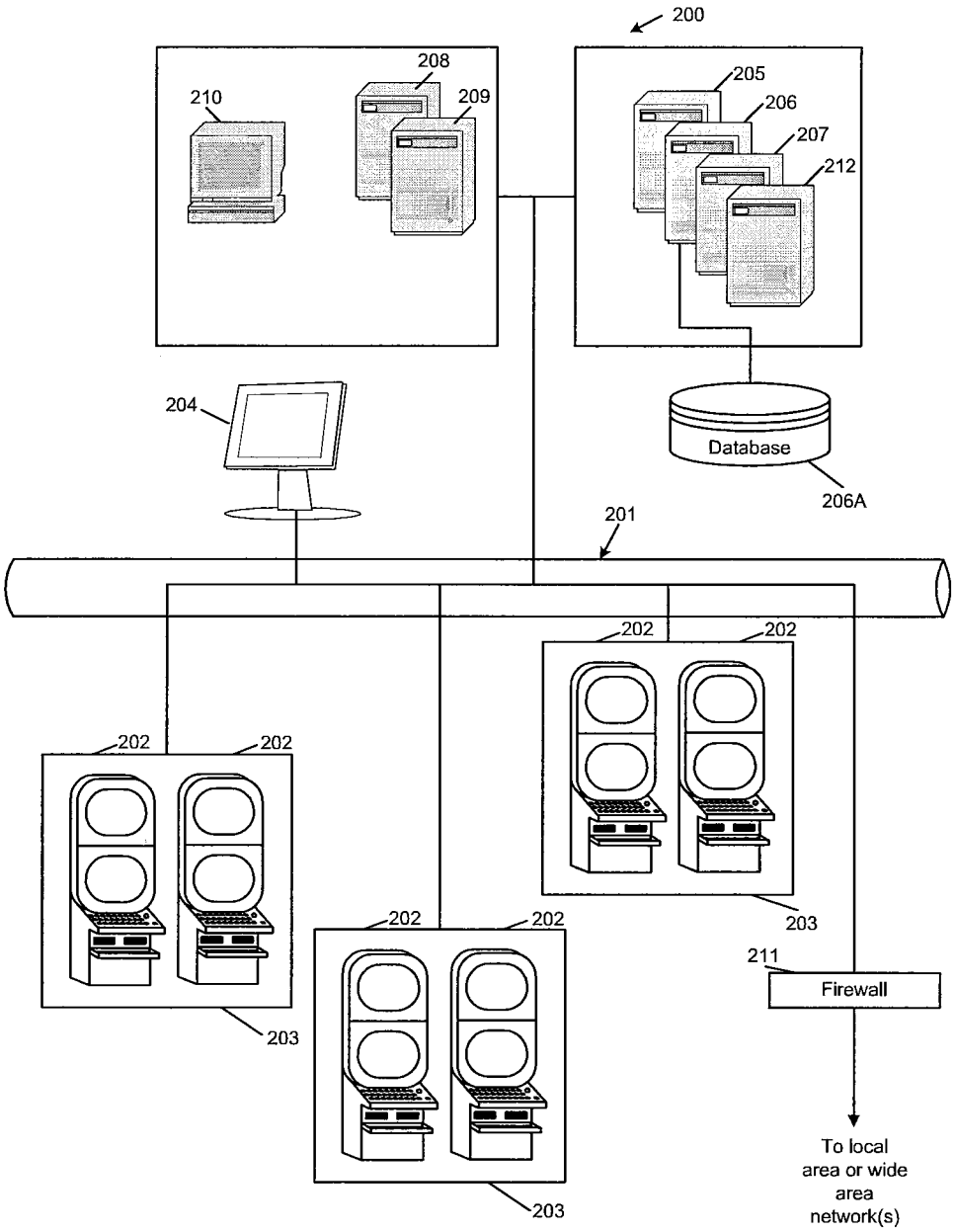
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming machines 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming system 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 of the player interface 50 to specify a wager and hence the win entitlement which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of pay lines and are an inherent part of the win entitlement.

Persons skilled in the art will appreciate that in other embodiments, the player may obtain a win entitlement by selecting a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the center row are used for non-selected reels. As a result, the total number of ways to win is determined by multiplying the number of active display positions of each reels, the active display positions being all display positions of each selected reel and the designated display position of the non-selected reels. As a result for five reels and fifteen display positions there are 243 ways to win.

In other embodiments a player win entitlement may be affected by purchasing access to particular pay tables—e.g. a first bet amount entitles the player to wins including cherries and a second amount entitles them to wins including plums.

In some embodiments, an eligibility criteria may be applied, for example that the player has made a certain sized wager, made an ante bet, selected all win lines, played sufficient games, or the player is a member of a loyalty program.

A game round includes play of a base game involving at least one of the reels being "spun"—e.g. new symbols of the reels are selected for display at the display positions and the reel is either physically or virtually spun to a stop. Persons skilled in the art will appreciate that there may be more than one game round in a play of a gaming machine such as is the case when a series of free spins is awarded. The outcome of play of a base game may be no win, a win (for example from a winning combination of symbols), a contribution towards a win accrued over a plurality of game rounds, a trigger condition occurring etc. Typically, a win will result in some form of award being made such as an award of credits. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

The base game is a part of the game which is carried out each time the player makes a wager, typically irrespective of the wager, whereas other parts of the game will only be carried out occasionally for example if a condition is met such as a trigger occurring or if an ante bet is placed (depending on the specific embodiment).

Figure 6A:
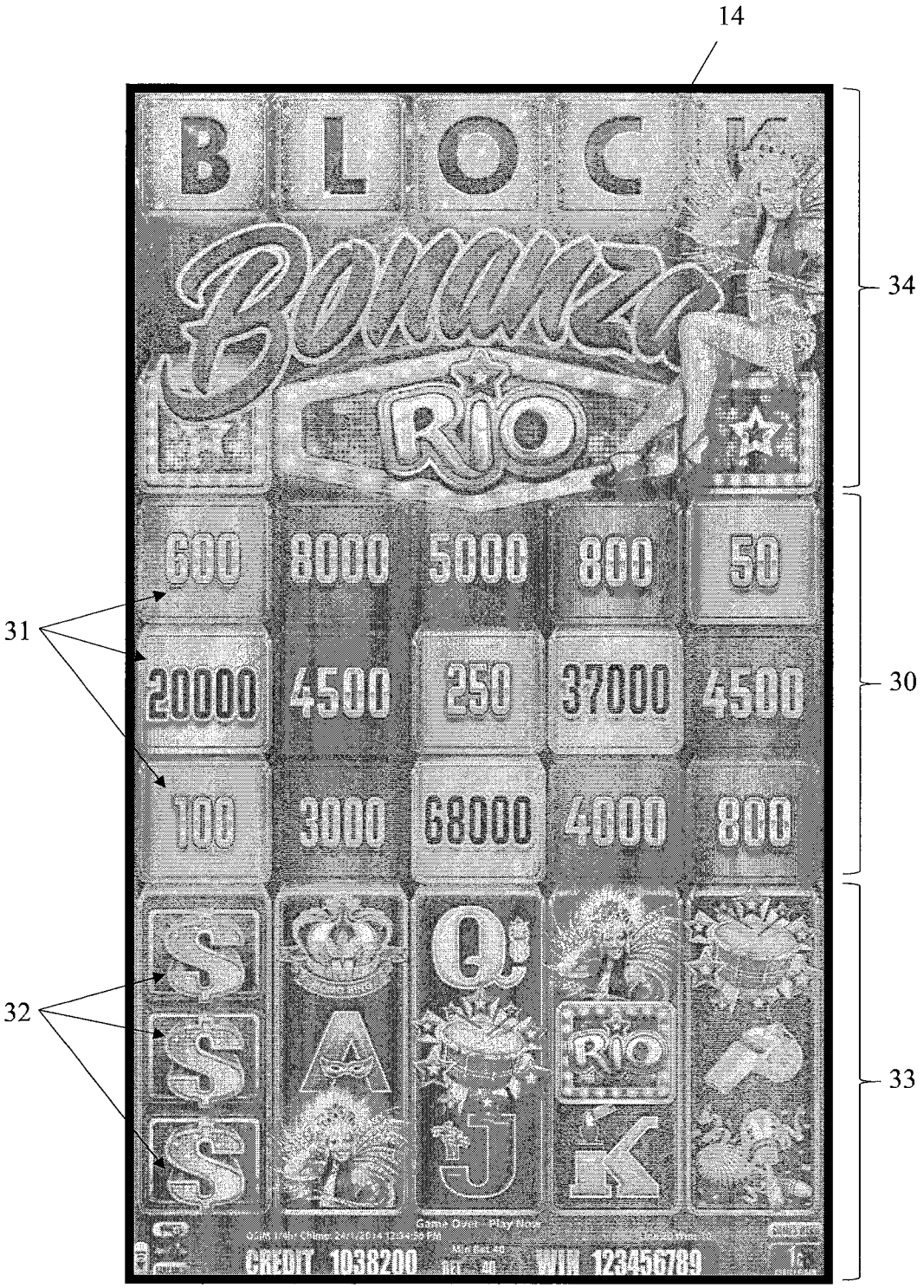
FIGS. 6*a*-6*d* show embodiments having a bonus array and base game.
Figure 6B:
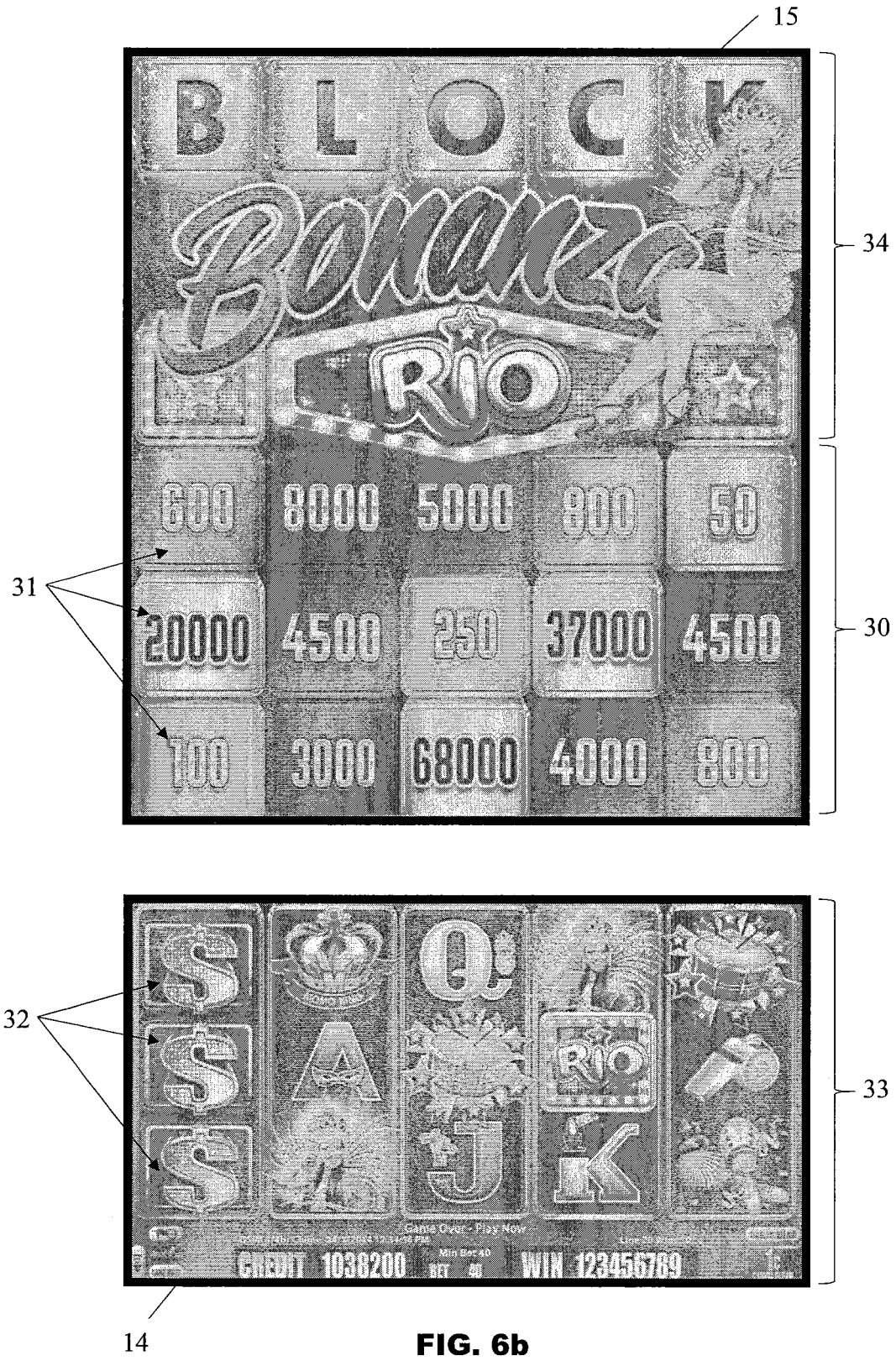

According to an embodiment, as shown in FIG. 6*a,* a dynamically generated bonus array 30 is displayed on the display 14 above a base game 33 (which is a reel game in the illustrated embodiment). Above the bonus array 30 is a title portion 34. In another embodiment, as shown in FIG. 6*b,* the bonus array 30 is displayed on an auxiliary display 15 above the display 14, which displays the base game 33. The title portion 34 is shown, in this example, above the bonus array 30 displayed on the auxiliary display 15. The bonus array 30 and the base game are generated by the game controller 60.

Generally, the bonus array 30 is displayed in proximity to the base game 33, such that it is visible along with the reels of the base game 33. For example, as shown, the bonus array 30 is shown directly above the base game 33. The bonus array 30 comprises an arrangement of a plurality of visual elements 31. There is typically one visual element 31 for each symbol display position 32. Each visual element 31 is uniquely associated with a symbol display position 32. That is, a symbol display position 32 is at most associated with one visual element 31.

Typically, the visual elements 31 of the bonus array 30 are arranged such that the arrangement corresponds to the arrangement of symbol display positions 32. As shown diagrammatically in FIG. 6*c,* the location of each visual element 31 within the arrangement of visual elements 31 is the same as the location of its associated symbol display position 32 within the arrangement of symbol display positions 32. The broken lines indicate with which visual element 31 each symbol display position 32 is associated. Advantageously, this allows the player to determine the correlation between visual elements 31 and symbol display positions 32.

The visual elements 31 are dynamically generated, and each visual element 31 may be selected from a group of visual elements 31 (that is, there are a finite number of possible visual elements 31 for display, although these may be repeated). In this context, dynamically generated indicates that the specific arrangement of visual elements 31 is changeable, for example, between each play of the base game 33. In another example, the visual elements 31 are changed between every N games (where N≥1). In yet another example, the visual elements 31 may be changed between plays of the base game 33 in accordance with a predefined probability (such as, 10% of the time). In yet another example, the visual elements 31 may be changed in response to reception of a player input via the player interface 50.

Figure 6C:
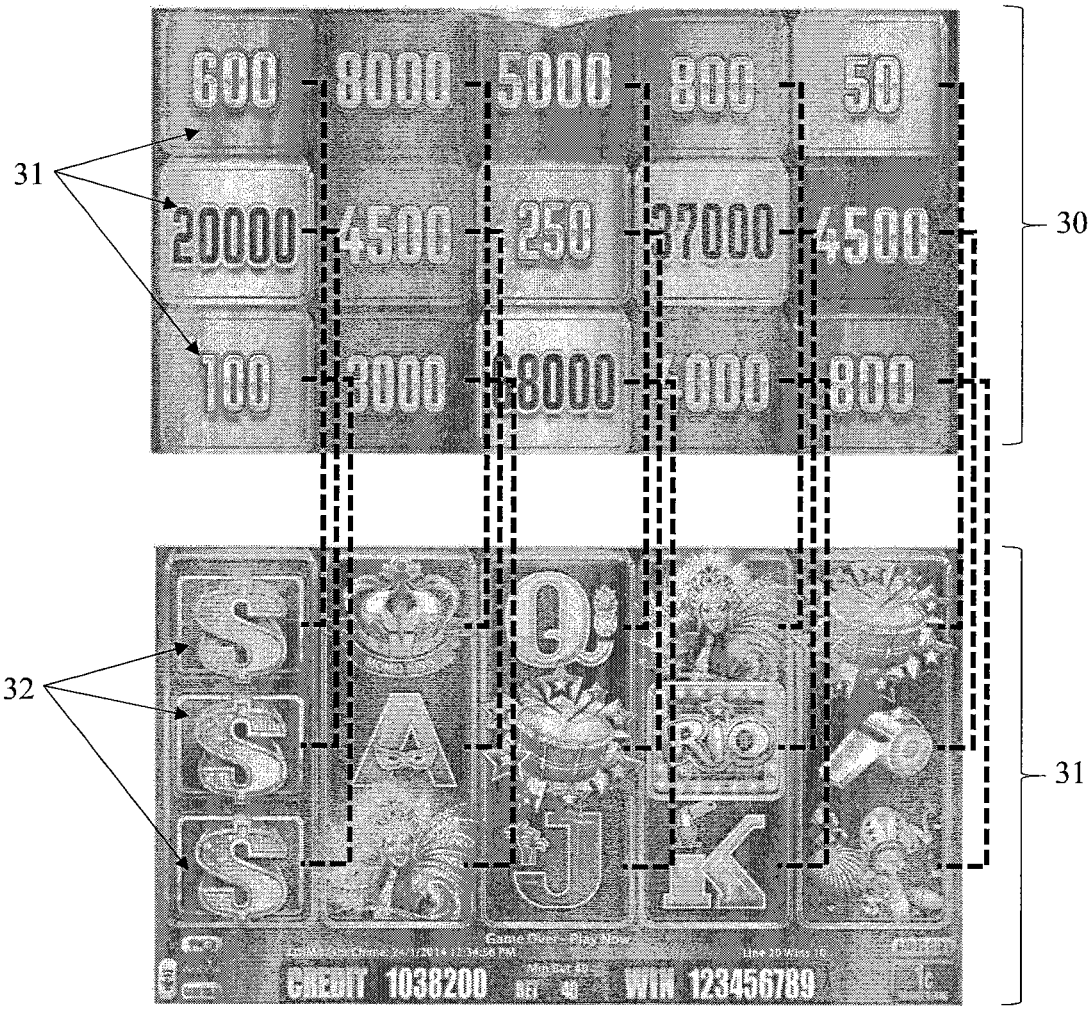

During gameplay of the base game 33, a symbol is associated with each symbol display position 32. The symbols are selected from a group of symbols including one or more trigger symbols and one or more non-trigger symbols. In FIGS. 6*a*-6*c*, the trigger symbol is the dollar sign ("$")—each of the three left-most symbol display positions 32 displays the trigger symbol in the example shown. For example, in the reel game shown in FIGS. 6*a*-6*c*, the reels are spun and the symbol association is the result of the spinning of the reels. For example, by randomly determining a stopping position for each of the reels. The game controller 60 determines whether a prize is to be made to the player based on the selection of symbols by reference to a pay table.

The game controller 60 determines whether one or more symbol display positions 32 are associated with trigger symbols as a result of gameplay of the base game 33. In the event that one or more symbol display positions 32 are associated with trigger symbols, the prize is modified based on the bonus prize of the visual element(s) 31 associated with the symbol display position(s) 32 associated with the trigger symbol(s). Typically, the visual elements 31 provide for a bonus prize award, which may be a numerical value for addition to any base prize or a multiplier for increasing as a multiple of the multiplier the value of any base prize. The prize is modified based on the bonus prize award or the combination of bonus prize awards.

Figure 6D:
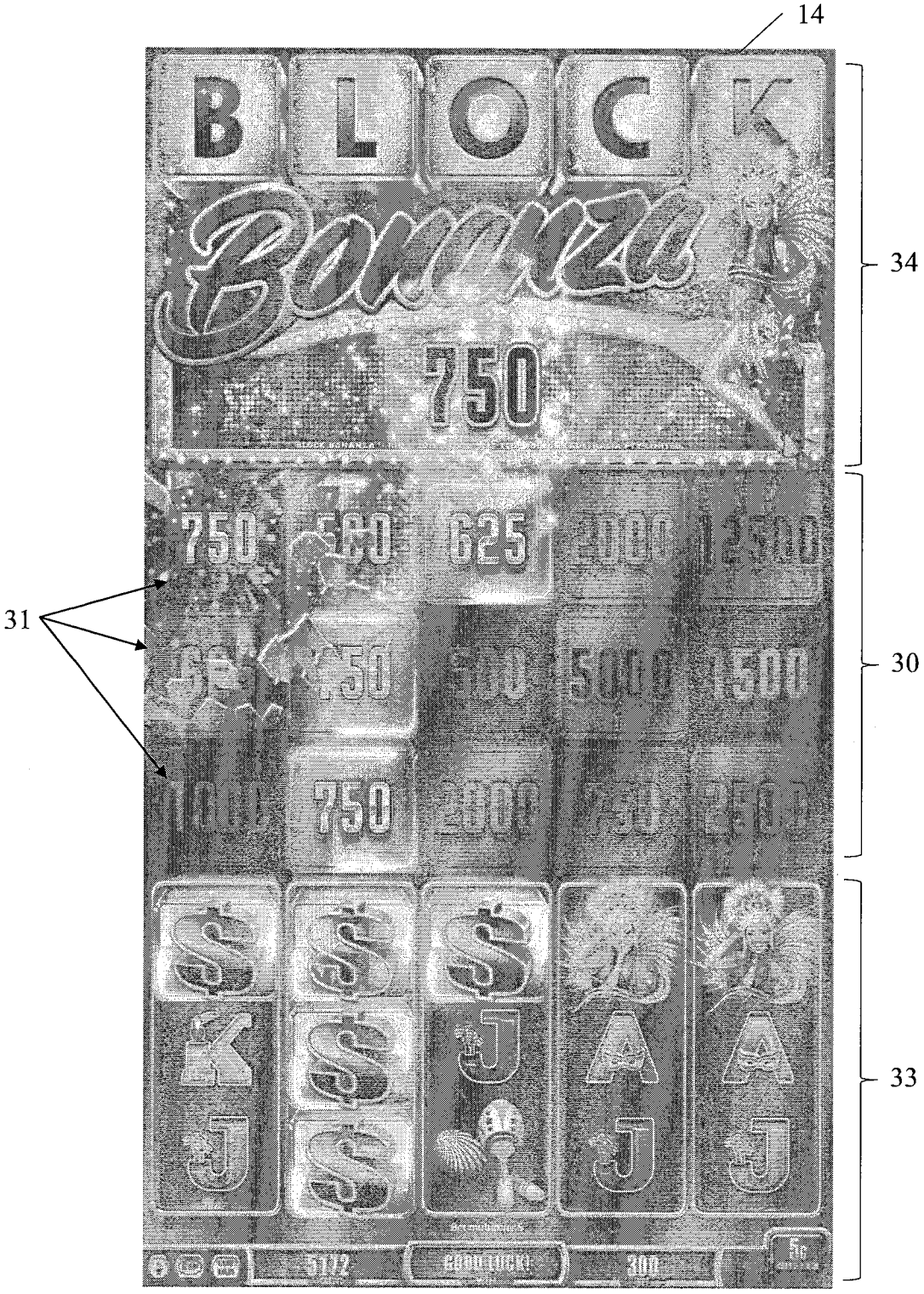
Figure 7:
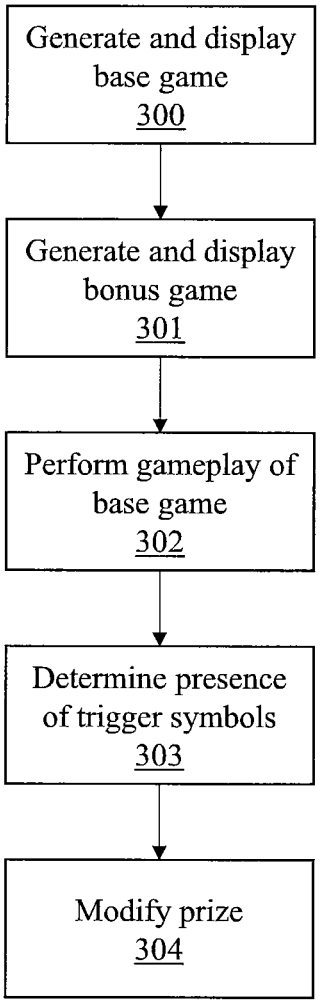
FIG. 7 shows a method of gaming according to an embodiment.

The prize modification may be communicated to the player visually. The visual communication may be static or animated. For example, as shown in FIG. 6*d*, each of the visual elements 31 contributing to the prize modification may be highlighted (see contributing indicia "750", "580", "625", "750" and "750"). The prize modification may be accompanied by an animated removal of the contributing visual elements 31 (e.g. an explosion or shattering of a block defining the indicia "750" at the top left corner). The animated removal of each contributing visual element may be sequential (e.g. one exploding or shattering block at a time), with each animated removal corresponding to modifying a prize counter at the top of the bonus array 30 in accordance with the bonus prize indicated on the contributing visual elements. Once all contributing visual elements have been removed (or as each contributing visual element is removed), new or remaining visual elements may move (e.g. fall downwardly) to re-occupy the space previously occupied by the removed visual elements.

In an embodiment, the visual elements 31 are generated such that the probability of a trigger symbol appearing in the associated symbol display position 32 of each visual element 31 combined with the bonus prize payout associated with the visual element 31 is such that the long-term expected return to player meets a predetermined criteria. Typically, this long-term expected return to player based on the visual elements 31 is combined with the expected return to player of the base game 33, and this is configured to meet the predetermined criteria. For example, the entire combination of base gameplay and bonus gameplay may be configured to provide an expected payout within $0.80-0.90 for every $1 spent by the player. The generation of the visual elements 31 may be dependent, at least in part, on the particular location of the visual element 31—equivalently, the particular location of its associated symbol display position 32. In an embodiment, upon occurrence of a triggering condition, a generated visual element may be modified. For example, as depicted in FIG. 6*d*, upon appearance of a special triggering symbol in the base game 33 (e.g. a "diamond $" symbol in the top row, second column from the left), the corresponding visual element in the bonus array 30 is modified in its appearance (e.g. with a mosaic background) as well as in its bonus prize payout (e.g. increased from originally generated value "250" to modified value "500").

Referring to FIG. 8, a method of gaming is shown according to an embodiment. A base game is generated, in the sense that a visual representation of an initial state of the base game is displayed on a display, at step 300. The base game is associated with a plurality of displayed symbols each uniquely associated with a symbol display position (that is, as shown in FIGS. 6*a*-6*c*, the base game comprises reels each having symbols). A bonus array is also generated and displayed at step 301. Gameplay of the base game is performed at step 302. This can correspond to the apparent spinning of the displayed reels, with a final set of symbols displayed once the reels stop spinning. It is necessary to determine whether or not there are trigger symbols displayed—although, it is understood that the game controller 60 may determine the presence of trigger symbols before or during spinning of the reels. Assuming that there are trigger symbols, the method will determine that one or more symbol display positions contain trigger symbols at step 303. In response, a modification to the base prize is determined in dependence on the bonus associated with the, or each, visual element associated with a symbol display position containing a trigger symbol and modifying the base price accordingly, at step 304.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

Further modifications can be made without departing from the spirit and scope of the specification.

The invention claimed is:

1. An electronic gaming machine comprising a game controller, a player interface, and a display device, wherein the game controller executes instructions from a memory which cause the game controller to at least:

display a plurality of symbol display positions;

display a bonus array comprising a plurality of visual elements, each visual element being uniquely associated with a symbol display position from the plurality of symbol display positions during play of a base game, at least one visual element indicating a bonus award;

select a symbol, from a group of symbols including one or more trigger symbols and one or more non-trigger symbols, for display at each of the plurality of symbol display positions;

determine whether at least one of the plurality of symbol display positions contains the one or more trigger symbols;

upon determining that the at least one of the plurality of symbol display positions contains the one or more trigger symbols, determine a modification to a base prize, if any, based at least in part on a visual element associated with the at least one of the plurality of symbol display positions containing the one or more trigger symbols; and cause an animated removal of any symbol display position containing the one or more trigger symbols to be displayed.

2. The electronic gaming machine of claim 1, wherein each of the at least one visual element indicating a bonus award is associated with at least one of a numerical value for addition to the base prize or a multiplier for multiplying the base prize.

3. The electronic gaming machine of claim 1, wherein the bonus array and the base game are displayed on the same display device.

4. The electronic gaming machine of claim 1, wherein the bonus array is displayed on an auxiliary display device.

5. The electronic gaming machine of claim 1, wherein each visual element is selected from a group of the plurality of visual elements.

6. The electronic gaming machine of claim 1, wherein the game controller executes instructions from a memory which cause the game controller to change the visual elements of the bonus array after every N plays of the base game (where N≥1).

7. The electronic gaming machine of claim 1, wherein the game controller executes instructions from a memory which cause the game controller to change the visual elements of the bonus array between plays of a base game in accordance with a predefined probability.

8. The electronic gaming machine of claim 1, wherein the game controller executes instructions from a memory which cause the game controller to change the visual elements of the bonus array in response to a player input.

9. The electronic gaming machine of claim 1, wherein the bonus array is displayed on a touch screen and wherein the game controller executes the instructions from the memory which cause the game controller to enable a player to move a visual element via a touch input.

10. The electronic gaming machine of claim 1, wherein a probability of a trigger symbol being associated with a particular symbol display position is at least in part determined by a requirement to meet a predetermined criteria.

11. The electronic gaming machine of claim 1, wherein the game controller executes instructions from a memory which cause the game controller to cause an animated removal of the, or each, symbol display position containing a trigger symbol to be displayed on the display.

12. A method of operating a gaming machine comprising a game controller, a player interface, and a display device, comprising:

displaying a plurality of symbol display positions;

displaying a bonus array comprising a plurality of visual elements, each uniquely associated with a symbol display position from the plurality of symbol display positions during play of a base game, at least one visual element indicating a bonus award;

selecting a symbol, from a group of symbols including one or more trigger symbols and one or more non-trigger symbols, for display at each of the plurality of symbol display positions;

determining whether at least one of the plurality of symbol display positions contain the one or more trigger symbols;

upon determining that the at least one of the plurality of symbol display positions contains the one or more trigger symbols, determine a modification to a base prize, if any, based at least in part on a visual element associated with the at least one of the plurality of symbol display positions containing the one or more trigger symbols; and displaying an animation showing removal of any symbol display position containing the one or more trigger symbols.

13. The method of claim 12, wherein each of the at least one visual element indicating a bonus award is associated with at least one of a numerical value for addition to the base prize or a multiplier for multiplying the base prize.

14. The method of claim 12, further comprising displaying the bonus array and the base game are displayed on the same display device.

15. The method of claim 12, further comprising displaying the bonus array on an auxiliary display device.

16. The method of claim 12, further comprising selecting each visual element from a group of the plurality of visual elements.

17. The method of claim 12, further comprising changing the visual elements of the bonus array after every N plays of the base game (where N≥1).

18. The method of claim 12, further comprising changing the visual elements of the bonus array between plays of the base game in accordance with a predefined probability.

19. The method of claim 12, further comprising changing the visual elements of the bonus array in response to a player input.

20. The method of claim 12, further comprising displaying the bonus array on a touch screen and enabling a player to move a visual element via a touch input.

* * * * *